US007017218B2

(12) United States Patent
Nguyen

(10) Patent No.: US 7,017,218 B2
(45) Date of Patent: Mar. 28, 2006

(54) CUSTOMIZED ORTHOPEDIC SOLE-INSERT AND METHOD FOR MAKING

(76) Inventor: Tim The Nguyen, 1264 Vida Dr., Oxnard, CA (US) 93030

( * ) Notice: Subject to any disclaimer, the term of this patent is extended or adjusted under 35 U.S.C. 154(b) by 183 days.

(21) Appl. No.: 10/707,046

(22) Filed: Nov. 18, 2003

(65) Prior Publication Data

US 2005/0102771 A1 May 19, 2005

(51) Int. Cl.
*A43B 13/38* (2006.01)
*B29B 15/10* (2006.01)

(52) U.S. Cl. ..... 12/142 N; 12/146 M; 36/44; 36/140; 36/154

(58) Field of Classification Search ..... 12/142 N, 12/146 M, 146 R, 142 R; 264/223; 36/44, 36/140, 71, 154
See application file for complete search history.

(56) References Cited

U.S. PATENT DOCUMENTS 2,092,910 A * 9/1937 Daniels ..... 36/154
2,366,323 A * 1/1945 Fried ..... 36/154
4,433,680 A 2/1984 Yoon ..... 128/90
4,627,179 A * 12/1986 McElroy ..... 36/44
5,042,100 A * 8/1991 Bar et al. ..... 12/142 N
5,095,570 A * 3/1992 Bar et al. ..... 12/142 N
5,203,793 A * 4/1993 Lyden ..... 36/88
5,334,442 A 8/1994 Okamoto et al. ..... 442/224
5,687,441 A * 11/1997 Rachman et al. ..... 12/142 R
6,000,082 A 12/1999 Nguyen ..... 12/142
6,007,505 A 12/1999 Grim et al. ..... 602/6

* cited by examiner

*Primary Examiner*—Jila M. Mohandesi
(74) *Attorney, Agent, or Firm*—Ralph D. Chabot

(57) ABSTRACT

A method for making a customized sole insert for a user is disclosed. The insert is first manufactured in various sizes, widths and arch heights so that a user may select the insert best configured for his foot. The insert is initially comprised of a bottom layer or shell; a formable layer which can be hardened into a particular shape; and a top cushion layer for contact with a wearer's foot or sock. The shell has an aperture for injecting a hardening agent to accelerate the hardening of the formable layer. After the insert is selected, the hardening agent is injected through the aperture and the wearer stands upon the top cushion layer until the formable layer has hardened. The result is a formable layer which is substantially conformed to the plantar aspect of the wearer's foot.

11 Claims, 11 Drawing Sheets

116
120
110
118
112
A

CUSTOMIZED ORTHOPEDIC SOLE-INSERT AND METHOD FOR MAKING

BACKGROUND OF INVENTION

This invention relates to orthopedic inserts for a shoe and a method to customize the insert for a particular user quickly and efficiently.

The human foot is a unique structure that can be very flexible or very rigid when a person walks depending upon the internal locking and unlocking mechanism of the bones and joints in the person's foot.

This mechanism will not function properly if the bones and joints of the person's foot and ankle are in abnormal alignment. If such an abnormal alignment is present, muscles in the lower extremities will be required to work harder to control the alignment of bones and joints. As a consequence, these muscles will fatigue quicker. Once muscles fatigue, the person will experience pain and discomfort because the muscles can no longer compensate for the abnormal alignment of the foot and ankle.

There have been many developments in the prior art addressing abnormal alignment of the foot and ankle. Besides invasive surgery, shoe-inserts have been developed. These inserts are positioned between the bottom or plantar aspect of a person's foot and the shoe. The custom sole shoe-insert supports the bones and joints to maintain the normal alignment and redistributes the pressure exerted by a person's body weight upon the plantar aspect of the foot so that the person can walk with greater stability and in more comfort.

A typical method in the prior art is to make a plaster cast of the foot of a person or patient and then have a customized insert manufactured based upon the plaster cast along with any required modifications according to the specific needs of the patient as determined by the attending podiatrist. This type of procedure is expensive, and requires a substantial amount of time between the initial plaster cast and the final product; sometimes on the order of weeks.

Therefore, a patient must endure the pain of improper alignment until the insert is made to the satisfaction of the attending podiatrist. Also, due to the expense, a patient normally can not afford additional inserts and will typically use the same insert when wearing different shoes.

More recent prior art has attempted to address the problems associated with the expense and time for making a custom insert. U.S. Pat. No. 6,000,082 issued to Nguyen illustrates a method for making a custom insert using a pre-made sole having downward extending elongated members. The pre-made sole rests upon a special cutting machine. The elongated members are cut according to the weight distribution across the top surface of the insert. Although this method is workable, the marketplace is desirous of a more simpler design and method.

SUMMARY OF INVENTION

As used in my specification, the terms patient, user, wearer, and person are interchangeable and have the same meaning.

The term "insert" refers to my invention before customization.

The term "sole-insert" refers to the portion of my invention which, after customization, can be used by a wearer in his shoe.

The objects of my invention are as follows:

1. To provide a method for making a customized a sole-insert for a shoe quickly using a layer of formable material which can be permanently hardened once a customized shape is obtained;

2. To provide a sole-insert specific to the needs and requirements of a patient;

3. To provide an insert which is not expensive to manufacture, and, as a consequence, a user may be able to afford to purchase other inserts for other shoes worn by the user; and, 4. Supervision of a podiatrist is not necessary and the insert can be customized by the user at a time and place of the person's choosing.

My invention is a method for making a customized sole-insert. It incorporates the use of what I term a formable layer. This formable layer is made of a sufficient thickness so it can be contoured to the adjacent plantar aspect area of a user's foot and thereafter permanently harden shortly after contact with an accelerant or activation agent.

The formable layer can be made of various material. Accordingly, the hardening agent or accelerant utilized will depend on the material comprising the formable layer. The preferred material to use would be a polyurethane casting material such as that disclosed in U.S. Pat. No. 4,433,680 issued to Yoon and improved upon in U.S. Pat. No. 6,007,505 issued to Grim et al. The improvement under Grim et al. is the addition of hydroxypropyl methyl-cellulose (HPMC) which prevents urethane from becoming sticky when contacted with water. The material made according to Grim et al. is sealed in a package and is pliable if kept within the package or shortly after being removed. Contact with water will accelerate the hardening process but the material will harden at ambient conditions without the addition of water, although more slowly.

Another material which could be used as the formable layer is one made from fiberglass fabric impregnated with a water hardenable material as disclosed in U.S. Pat. No. 5,334,442 issued to Okamoto et al. The formable layer made according to my invention should not be limited to those materials disclosed herein. Other suitable materials can be used so long as they can be adapted to be formed to the plantar aspect of a user's foot and harden to that shape in a short period of time. It may be possible to select a formable layer comprised of a material which will not harden at ambient conditions without first coming into contact with an activation agent.

The insert comprises a bottom shell and located above the top surface of the bottom shell, a formable layer as discussed above. The main function of the bottom shell is to provide resistance against the downward force applied by a user's foot and allow the formable layer to conform to the adjacent plantar aspect of a wearer's foot before hardening to a permanent shape.

The required thickness of the formable material layer varies and is dependent upon shoe size, width, arch and material considerations. Where the preferred material of polyurethane casting material is used, the thickness of the formable layer will typically be in the range of 1–15 mm and most preferably between 3–4 mm.

The insert can be made so that it is limited to the general area adjacent to and about the arch of a foot or it can extend the length of the foot. Preferably, the formable material layer can extend from under the heel to either under the metatarsal or toe areas. Also, the insert can include a heel seat that can cover around the heel. The top surface of the heel seat has a flat central area to provide stability to the user when he is standing and applying downward pressure.

It should be understood that embodiments of my insert can be manufactured in various sizes, widths, and arch heights so that a person can select the proper insert which will fit within an intended size and width of shoe.

The accelerant must be positioned for contact with the formable layer. Preferably, a means for delivering the accelerant into the insert is used. Any various means for delivery can be utilized which is common in the art. One type of delivery means is the use of a syringe to deliver a predetermined amount of accelerant into the insert. Besides a syringe, other devices can be adapted to inject the accelerant into the insert such as an eyedropper appropriately sized and configured. Another type of delivery means would incorporate a vessel containing a pre-determined amount of accelerant where the sides of the vessel are compressible and can be squeezed to force the accelerant out of the vessel and into the insert.

With this brief introduction, I now describe two primary embodiments.

First Embodiment—Soft Shell

The bottom shell is comprised of a thin layer of a soft, flexible plastic or rubber material. Where the accelerant is to be injected or delivered from outside the insert, the upward facing surface preferably includes a plurality of canals formed that emanate from a small area where the accelerant is to be delivered. Each canal is operatively connected to this small area so that a portion of the accelerant injected can flow away from the small area to distal areas using the canals. Preferably, this small area is located on the shell so it will be adjacent the arch area of the foot.

Preferably, located directly above the bottom shell is a thin sponge layer. The sponge layer ensures a more even distribution of the accelerant agent. Located above the sponge layer is the formable layer. Located above the formable layer is a top layer. The top layer can be made from any of the materials commonly used for manufacture of shoe inserts but would preferably comprise a water-proof or water-resistant component to prevent accelerant leakage. The periphery of the top layer is temporarily sealed to the bottom shell. Within the periphery of the temporary seal, the top layer is permanently attached to the formable layer.

In a preferred embodiment, a sock is secured to the bottom side of the bottom shell; preferably along its center line running toe to heel. Preferably, the bottom shell, sponge layer, formable layer and top layer are vacuum packaged to prevent undesired hardening should the temporary seal fail prematurely. Finally, provided is a hardening agent for injection.

With each part described, the method of use is now explained.

The first step is to select the proper size and width of insert to best fit the wearer and fit within his shoe.

The insert comprising the shell, sponge layer, formable layer and top layer are removed from the packaging. A means for delivering a sufficient amount of accelerant to the formable layer is provided. This can be accomplished by a syringe tip puncturing through the thin shell to create an aperture or a small aperture is already present. The syringe is sufficiently inserted so that the discharge can either flow into the canals or is absorbed by the sponge layer. Some of the accelerant flows in the canals to distal areas of the insert for absorbtion. Once the accelerant agent is injected and is substantially absorbed by the sponge layer, a user's foot is slipped into the sock so that the user's foot rests directly upon the top surface of the top layer. The sock and user's foot are then inserted into the desired shoe. The user stands in a normal fashion applying downward force upon the formable layer. Alternatively, the user may sit but continuing to apply downward force.

After a sufficient period of time, the formable layer is permanently hardened and the sock, bottom shell, and sponge layer can be separated from the newly hardened formable layer and top layer which are now collectively termed the sole-insert. The sole-insert is now customized for use with a specific shoe.

Second Embodiment—Semi-Rigid Shell

In this embodiment, the bottom shell is constructed of a thin, semi-rigid plastic or fiberglass material. Preferably, the material should be able to deform slightly under the weight applied by a foot.

In the preferred embodiment, there are several cuts about 0.5–1.0 cm into the periphery of the shell to allow for minimal flex when downward weight is applied during the fitting or molding process. These cuts serve to avoid distorting the shape of the sole insert during the fitting process.

The same parts are present as is the case for the soft shell embodiment except that a sock is not utilized. The base shell, which incorporates an arch area, provides resistance to the downward force applied by a user's foot. The formable layer, located in-between, is able to contour to the plantar aspect of the user's foot.

A means for delivering an accelerant for contact with the formable layer is provided as is the case for the first embodiment.

DETAILED DESCRIPTION

As explained above, my insert can be constructed having either a hard or soft bottom shell. The illustrations presented by FIGS. 1–11 provide general representations of my insert and accordingly, the illustrations should not be interpreted to limit the length, width, arch height, etc., of the insert to only that depicted.

Soft-Shell Embodiment

Figure 1:
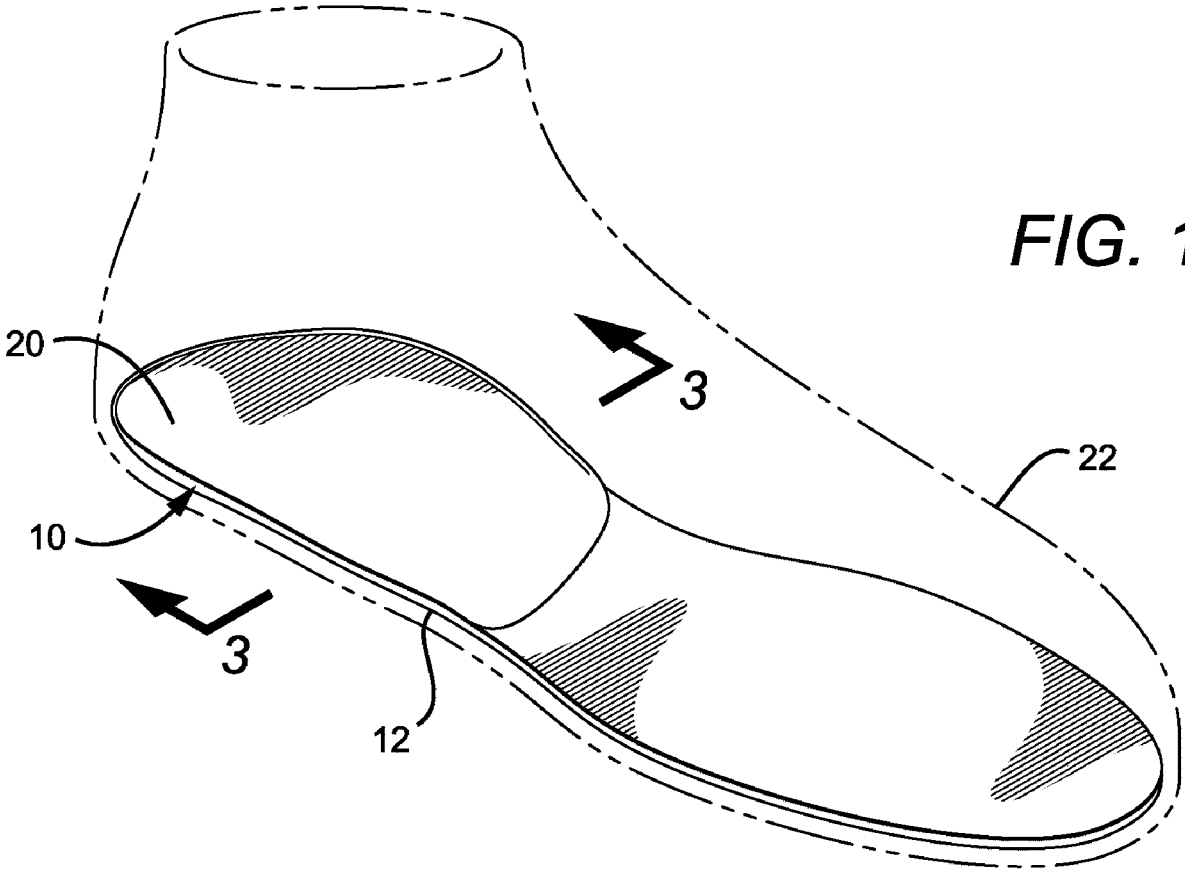
FIG. 1 is an overall representation of my soft-shell pre-made insert embodiment.
Figure 2:
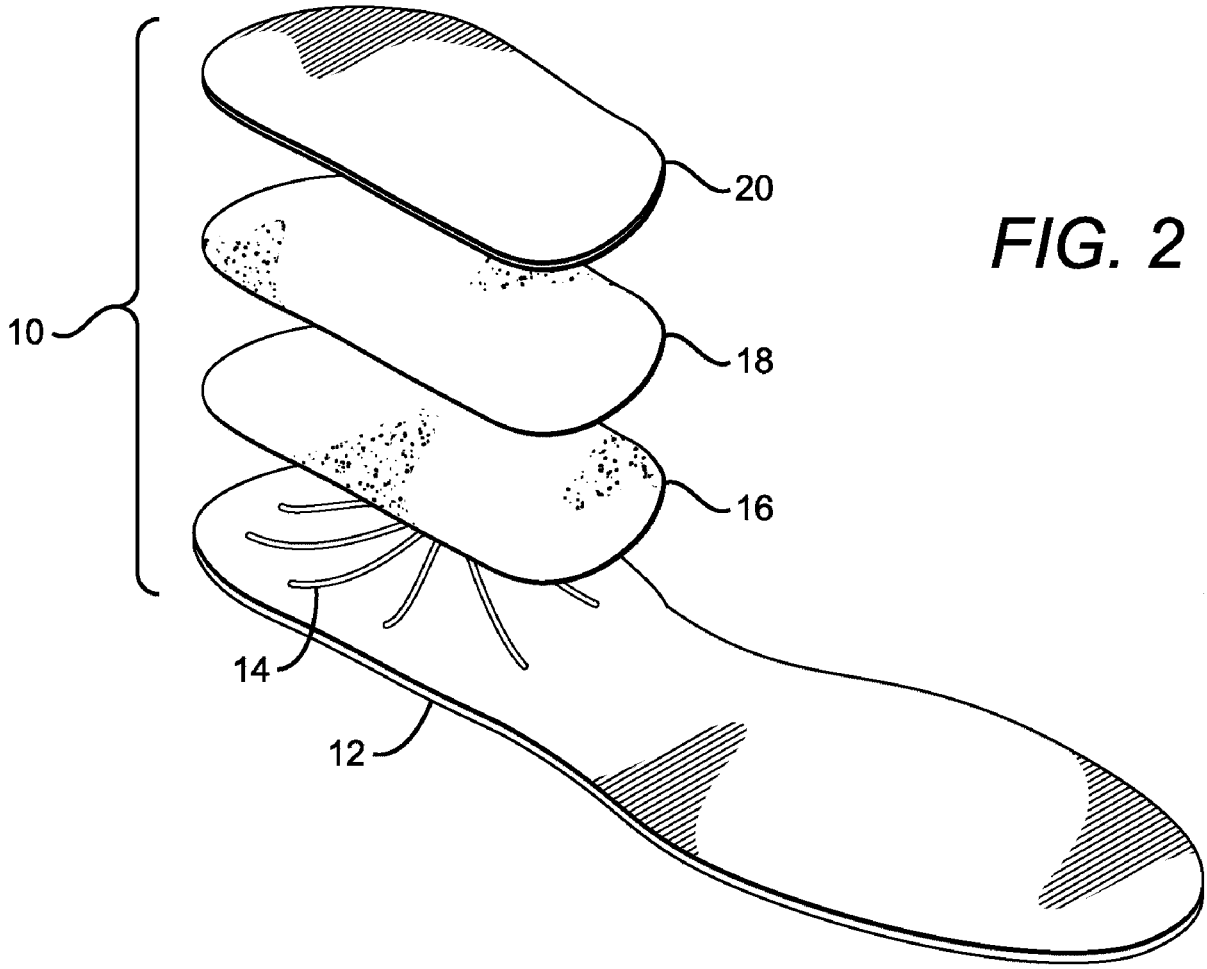
FIG. 2 is an exploded view of the pre-made insert of FIG. 1.

FIG. 1 illustrates an operational perspective view of my insert 10. A bottom shell 12 is constructed of a thin, pliable rubber. The top surface of shell 12 has a plurality of canals 14 that extend from aperture "A".

Figure 3:
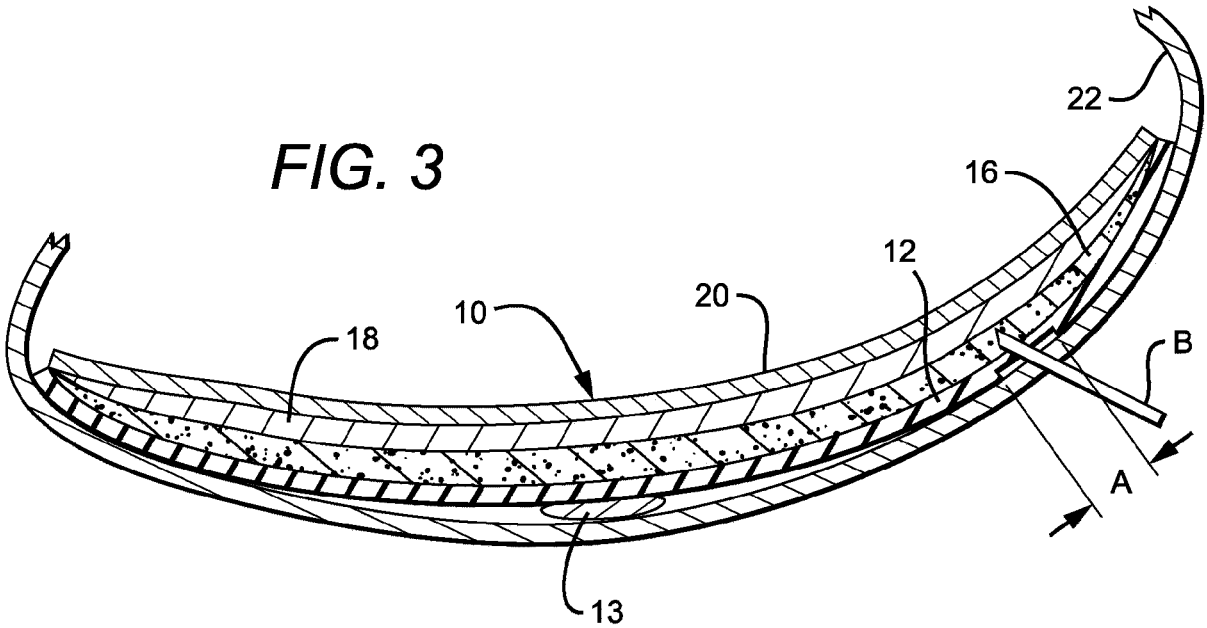
FIG. 3 is a view of line 3—3 of FIG. 1.
Figure 4:
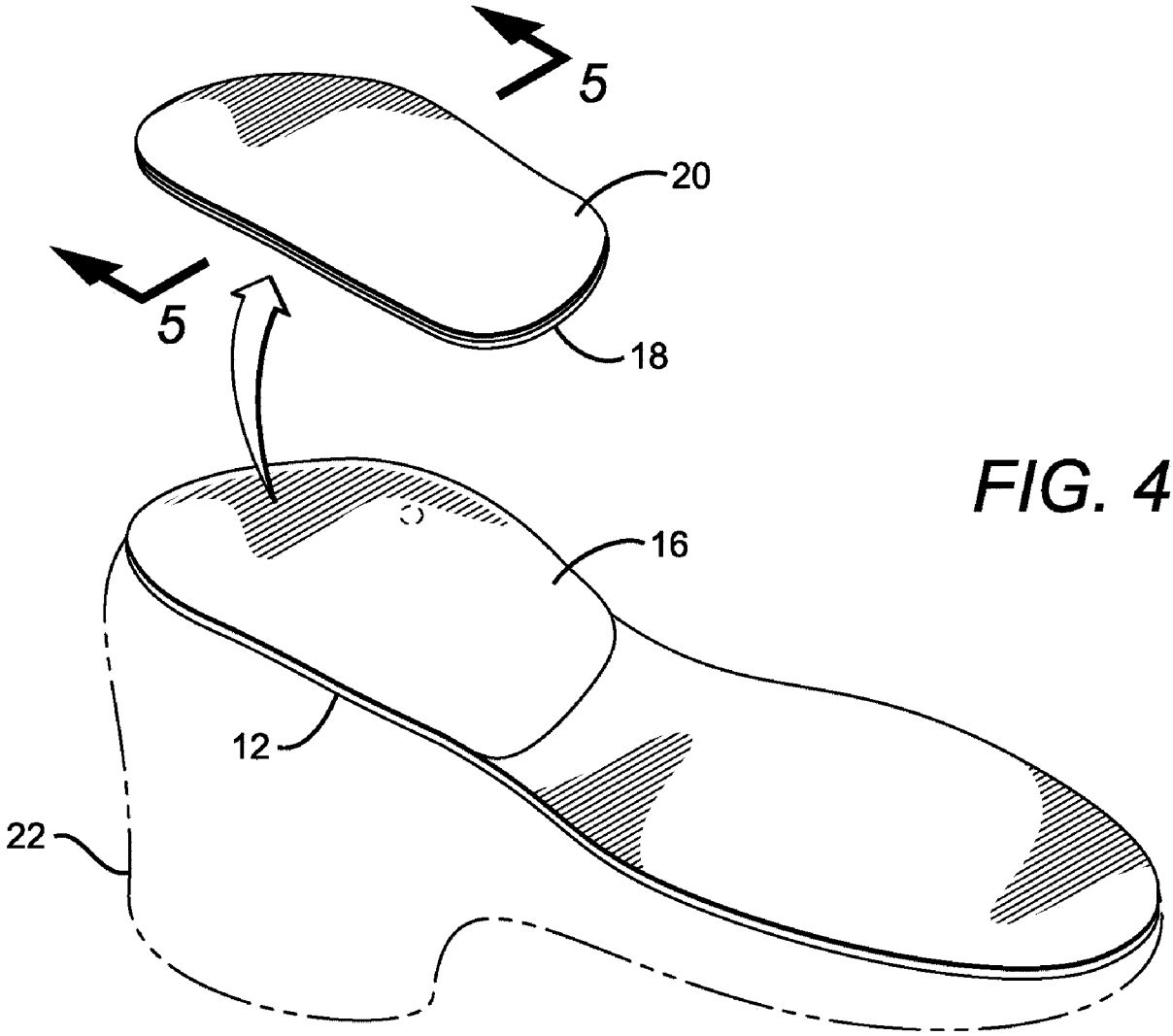
FIG. 4 illustrates the sole-insert being separated from the bottom shell.
Figure 5:
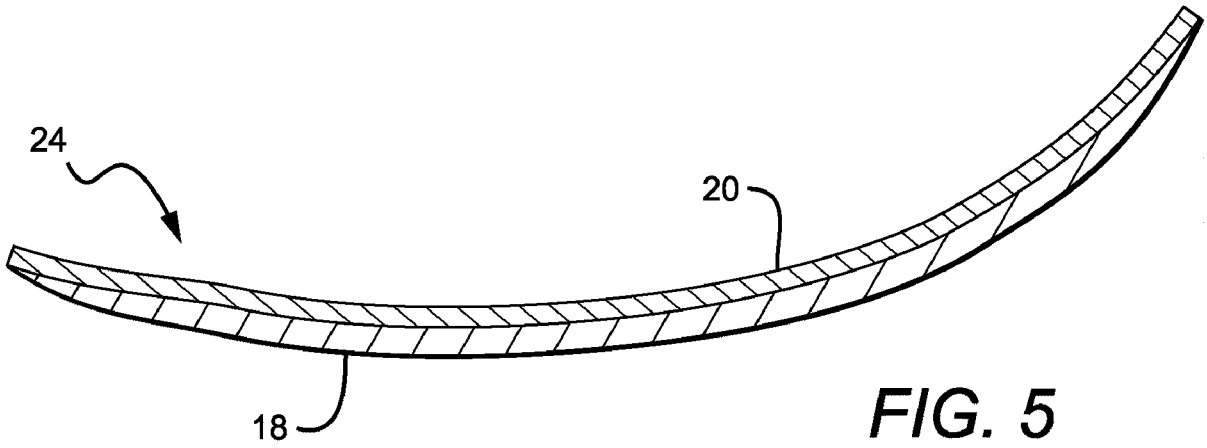
FIG. 5 is a view of line 5—5 of FIG. 4.

The layers which form my soft-shell embodiment are best illustrated in FIG. 3.

Positioned above bottom shell 12 is a sponge layer 16 and above layer 16 is a formable layer 18 comprising a sufficient thickness of woven polyurethane casting material with HPMC. Above formable layer 18 is a waterproof or water resistant cushion 20. Attached to the bottom side of shell 12 is a sock 22. Preferably, sock 22 is secured to the bottom side of shell 12 by using a strip of adhesive 13 which runs substantially the length of shell 12.

Aperture "A" is provided through shell 12 which permits a syringe "B" to penetrate into the insert and deliver a hardening agent to sponge layer 16 and canals 14.

The hardening agent for woven polyurethane casting material is water. As the water is injected, it becomes temporarily absorbed by sponge layer 16 either at the point of injection or at a distal location as a portion of the injected water flows away in canals 14.

With the component parts described, I now describe my method of customizing the sole-insert.

First, an appropriate insert 10 is selected. Inserts are manufactured in various sizes, widths and arch heights. Because of the hardening characteristics of polyurethane casting material, the inserts should be sold in air-tight packaging to prevent premature and inadvertent hardening of formable layer 18.

Once an insert 10 is selected, it is removed from its protective packaging and syringe "B", provided with insert 10, is used to inject a predetermined amount of water through sock 22 and aperture "A". The water will be temporarily absorbed by sponge layer 16.

The patient slips sock 22 over his foot and positions the insert so that cushion 20 is adjacent to the plantar aspect of his foot. As the patient raises sock 22 up his calf, a portion of the periphery of bottom shell 12 deforms upward about the heel and sides of the foot.

The patient next places his foot into a shoe and stands so that his weight is evenly distributed upon both feet. As he does so, formable layer 18 begins to deform to the plantar aspect of the foot. Additionally, the weight placed by the patient upon formable layer 18 also subjects sponge layer 16 to a downward force which causes the water previously absorbed by layer 16 to discharge into formable layer 18. The patient is required to maintain a downward force upon the insert for a sufficient period of time so that the water will accelerate the hardening process of formable layer 18.

Once formable layer 18 is substantially hardened, the patient will remove his foot from the shoe and sock 22. Next, as reflected in FIG. 4 and FIG. 5, formable layer 18 and cushion layer 20 are separated from sock 22, shell 14 and sponge layer 16. Layers 18 and 20 are now defined as the customized sole-insert 24 and can be used for support in the patient's shoe without the need for shell 14.

Semi-Rigid Shell Embodiment

Figure 6:
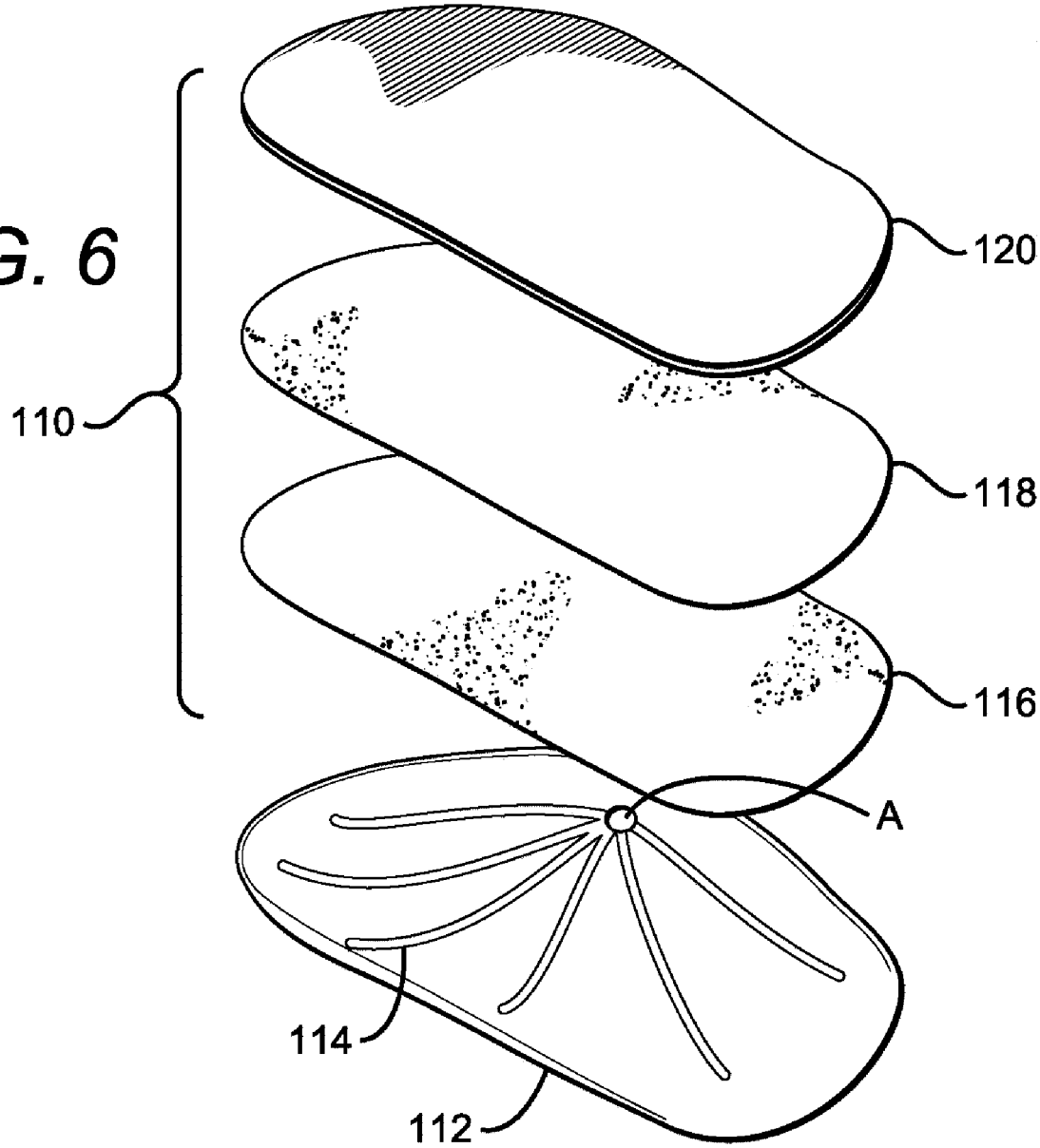
FIG. 6 is an exploded view of the hard-shell embodiment of the pre-made insert.
Figure 8:
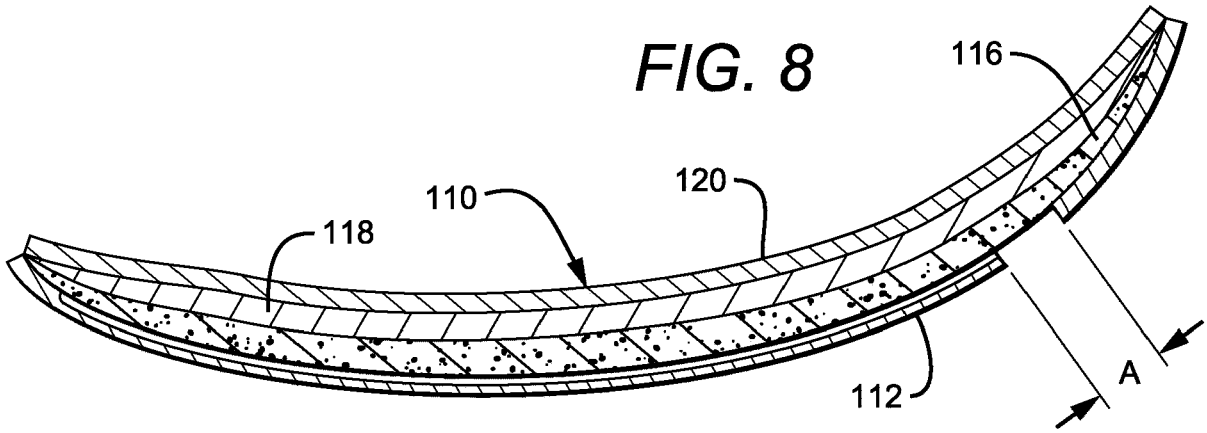
FIG. 8 is a view of line 8—8 of FIG. 7.
Figure 9:
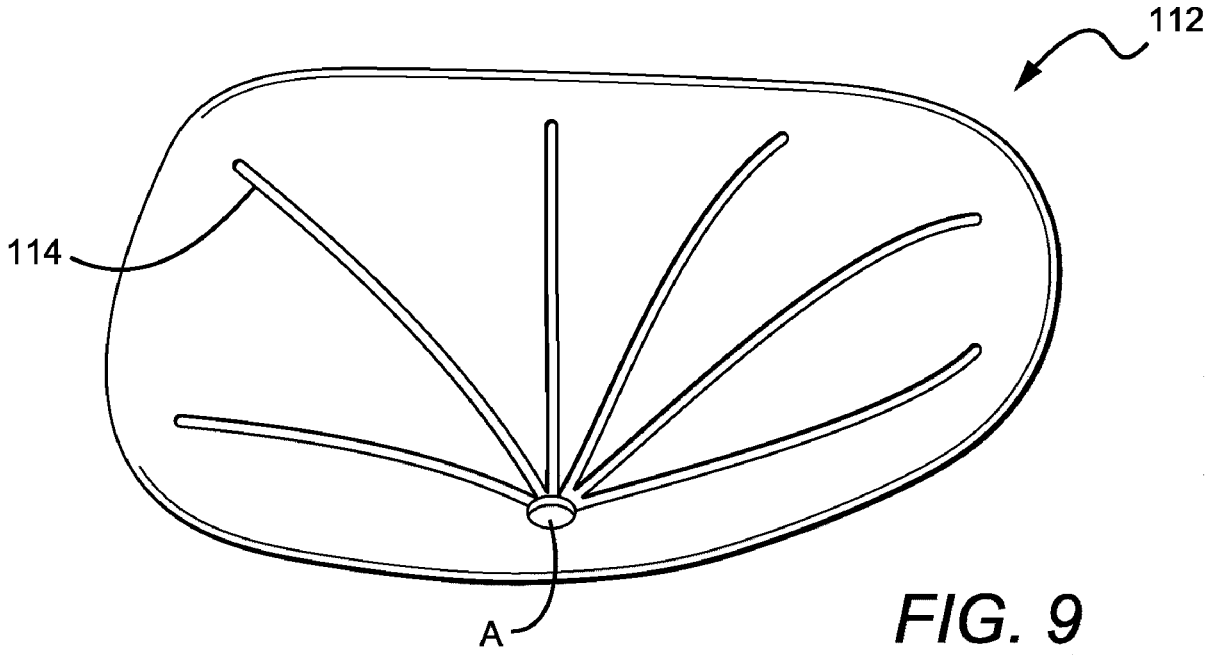
FIG. 9 is a top surface view of the bottom shell.
Figure 10:
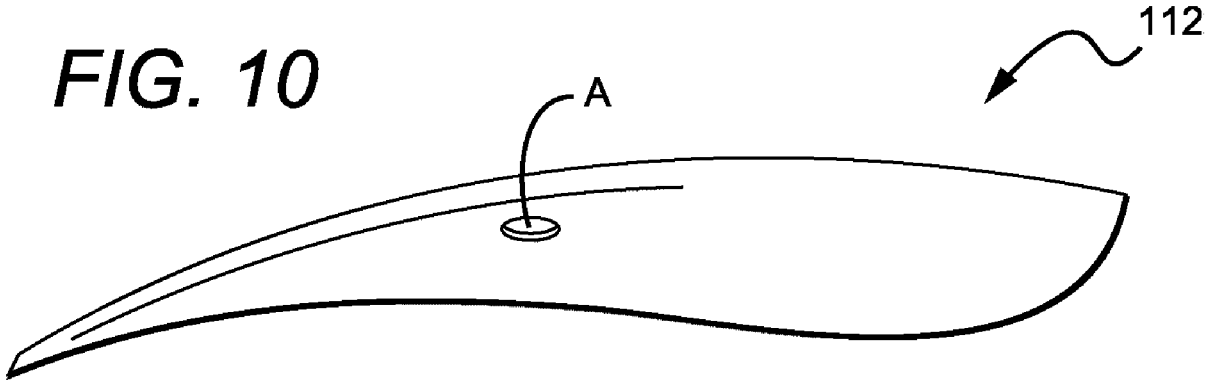
FIG. 10 is a side view of the bottom shell.

FIG. 6 illustrates an exploded view of my insert 110. A bottom shell 112 is constructed of a pre-made shell having a contoured arch. Shell 112 is formed from a thin layer of fiberglass or alternatively is injection molded with a hard plastic material such as high density polyethylene. The top surface of shell 112 has a plurality of canals 114 that extend from aperture "A" as shown in FIG. 6 and FIG. 9. Aperture "A" extends from the top surface to the bottom surface of shell 112 as illustrated in FIG. 8. Aperture "A" is positioned in the arch area of the insert as shown in FIG. 10.

Figure 7:
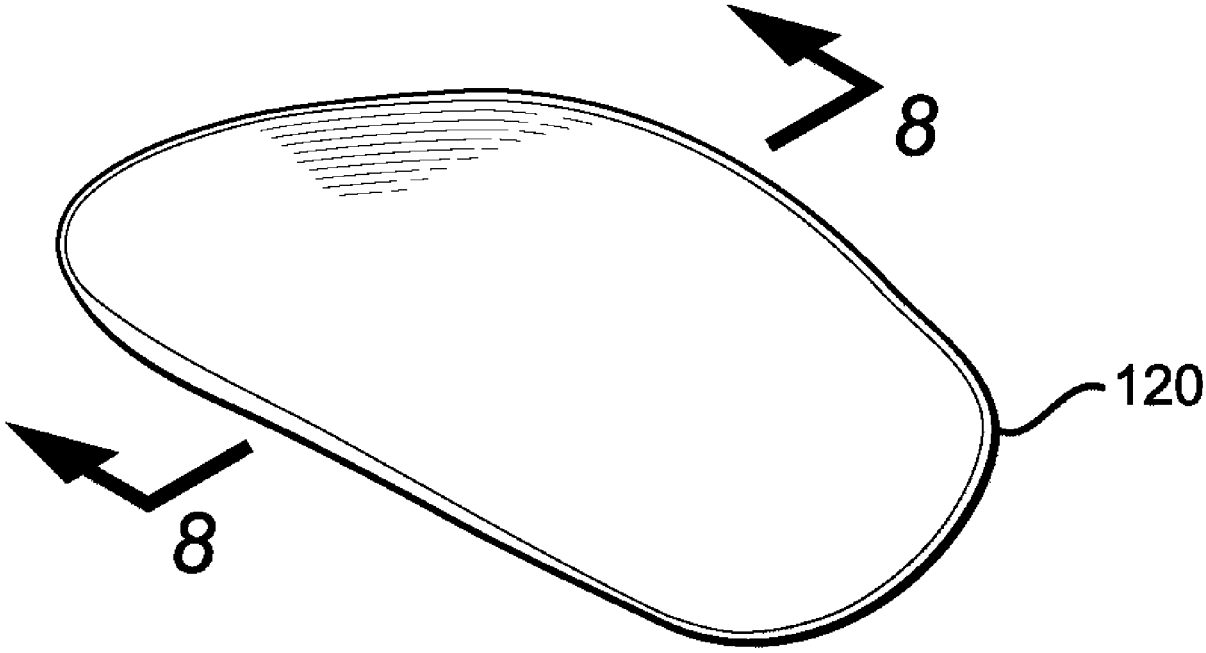
FIG. 7 is a top perspective view of the hard-shell embodiment.
Figure 11:
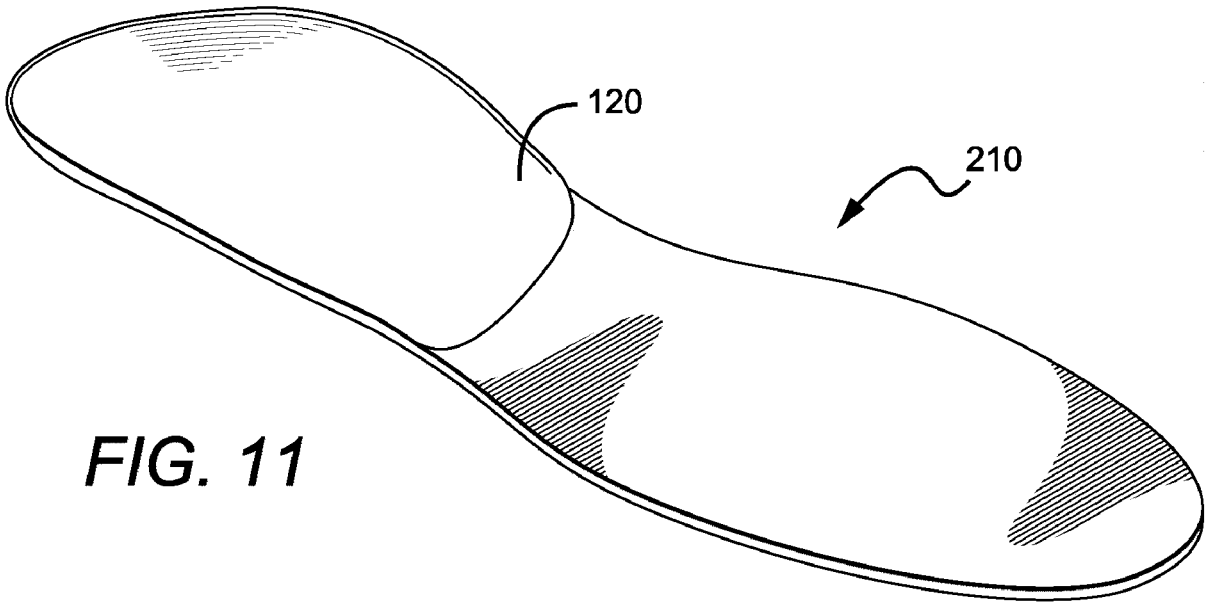
FIG. 11 is a perspective view of the hard-shell pre-made insert embodiment.

FIG. 8 illustrates a cross sectional view of insert 110 taken along line 8—8 of FIG. 7. Positioned upon the top surface of shell 112 is a sponge layer 116 for temporarily absorbing the hardening agent and for subsequent distribution in the manner described earlier for the soft-shell embodiment. Positioned upon sponge layer 116 is a formable layer 118 comprising a sufficient thickness of woven polyurethane casting material with HPMC. Positioned upon formable layer 118 is a top cushion 120. The periphery of cushion 120 and bottom shell 112 are joined so that formable layer 118 remains between both cushion 120 and shell 112 at least until the activation/hardening process has been substantially completed. FIG. 11 shows an alternative embodiment where the insert 210 can be incorporated so that it is not limited to an area opposite the arch of a foot but can be extended along the entire plantar aspect of a foot from heel to toe.

Various sizes of my insert are manufactured so that a user has multiple choices from which to select the best fitting insert for customization with his foot. Additionally, each insert size may also have various selections for width and arch height. Once an insert is selected for a particular user, the hardening process can begin.

In order to initiate the hardening process, a syringe (not shown) is used to inject the hardening agent in the same manner shown for the soft-shell embodiment in FIG. 3. Polyurethane casting material with HPMC comprises formable layer 118 and water is the preferred hardening agent. Water is injected into the insert by inserting the syringe through aperture "A" so that water can either flow into canals 114 or be absorbed by sponge layer 118. The amount of hardening agent injected is calculated to be sufficient to essentially be absorbed by the formable layer 118 present between the top layer 120 and sponge layer 116. The function of canals 114 is to permit various routes away from aperture "A" so that the water injected can efficiently harden those portions of the formable layer 118 which are distal from aperture "A".

Once the hardening agent has been injected through aperture "A", insert 110 will be positioned within a user's shoe and the user will then insert his foot into the shoe upon insert 110. The user will next step upon insert 110 and maintain equal weight distribution to both feet until formable layer 118 has substantially hardened. As the user's foot contacts cushion material layer 120, the user's weight will deform formable layer 118 until it conforms to the adjacent plantar aspect of the user's foot. This hardening process should take no longer than a few minutes. Alternatively, once weight has been applied by standing upon the insert for a short period of time, the user may be seated and remain in a position so as to maintain some downward force upon the top of insert 110. A seated position will actually stabilize and prevent undesirable weight shifting which may occur if the user attempts to stand in one position for an extended period of time.

Once formable layer 118 has hardened, the user has some choices for wearing the now customized sole-insert.

The now hardened formable layer 118 and cushion 120 can be separated from shell 112 since the hardened formable layer 118 can support the wearer's weight. Alternatively, shell 112 can remain attached to cushion 120. In certain situations, the thickness of shell 112 will not interfere with normal wear in some type of shoes. The choice of leaving shell 112 as part of insert 110 once the activation process is complete is up to the user who may, remove altogether, leave together, or remove shell 12 when layers 18 and 20 will be used for some shoes and reattach shell 12 when the wearer will wear other shoes.

What is claimed is:

1. A method for making a customized sole insert comprising the steps of:

selecting an insert from a selection of inserts having various sizes, widths and arch heights, said insert comprising:

a bottom shell having a top surface, a bottom surface, an aperture extending from said top surface to said bottom surface, a plurality of canals emanating away from the aperture on said top surface;

a formable layer comprising a material which will permanently harden shortly after contact with an accelerant;

a top cushion, the circumference of said top cushion connected to said shell so that said formable layer is sealed between said top cushion layer and said shell;

injecting through said aperture a sufficient amount of accelerant to permanently harden said formable layer;

inserting said insert and the wearer's foot into the wearer's shoe upon said insert and applying a downward force upon the insert; and, maintaining a downward force upon said insert until said formable layer substantially hardens.

2. The method of claim 1 wherein said insert further comprises a sponge layer positioned between said bottom shell and said formable layer.

3. The method of claim 1 where said formable layer comprises a sufficient amount of polyurethane casting material and hydroxypropyl methyl-cellulose.

4. The method of claim 1 where said bottom shell is comprised of a thin layer of pliable material and a sock is disposed about said insert and where the wearer's foot is inserted into said sock prior to inserting said insert into a wearer's shoe.

5. The method of claim 4 where said formable layer comprises a sufficient amount of polyurethane casting material and hydroxypropyl methyl-cellulose.

6. The method of claim 3 wherein said insert further comprises a sponge layer positioned between said bottom shell and said formable layer.

7. A method for creating a sole insert which is custom fit to the plantar aspect of a wearer's foot comprising the step of:

providing a bottom shell comprising a top surface, a bottom surface, an arch area, an aperture extending from said top surface to said bottom surface, a plurality of canals emanating away from the aperture on said top surface, and where said aperture is positioned through said arch area;

providing a formable layer comprising a material which will permanently harden upon contact with an accelerant;

providing a top cushion;

disposing said formable layer between said top surface of the bottom shell and the top cushion;

connecting the circumference of said top cushion to said bottom shell so that said formable layer is sealed between said top cushion layer and said bottom shell;

providing a sufficient amount of accelerant; and, injecting said sufficient amount of accelerant into the formable layer and subsequently exerting downward forces upon said top cushion by a wearer's foot for a sufficient period of time, where said formable layer will confirm to the plantar aspect of said wearers foot and permanently harden.

8. The method of claim 7 where said formable layer comprises a sufficient amount of woven polyurethane casting material and hydroxypropyl methyl-cellulose.

9. The method of claim 7 wherein said insert further comprises a sponge layer positioned between said bottom shell and said formable layer.

10. A method for customizing a sale-insert comprising the steps of:

selecting an insert from a selection of inserts having various sizes, widths and arch heights, said insert comprising:

a bottom shell having a top surface, a bottom surface, an aperture extending from said top surface to said bottom surface, a plurality of canals emanating away from the aperture on said top surface;

a formable layer comprising a material which will permanently harden upon contact with an accelerant;

a top cushion, the circumference of said top cushion connected to said shell so that said formable layer is sealed between said top cushion layer and said shell;

means for delivering a sufficient amount of accelerant to permanently harden said formable layer;

thereafter, inserting said insert into a wearer's shoe;

thereafter, inserting the wearer's foot into the wearer's shoe upon said insert and applying a downward force upon the insert;

thereafter, maintaining a downward force upon said sole insert until said formable layer substantially hardens; and, separating the top cushion and hardened formable layer from the bottom shell, the top cushion and hardened formable layer now collectively referred to as a customized sole insert.

11. The method of claim 10 where said formable layer comprises a sufficient amount of woven polyurethane casting material and hydroxypropyl methyl-cellulose.

* * * * *